United States Patent [19]

Mayer et al.

[11] 4,272,660

[45] Jun. 9, 1981

[54] VACUUM OPERATED SWITCH

[75] Inventors: William R. Mayer, Rochester; James R. Pescetto, Springfield, both of Ill.

[73] Assignee: Stewart-Warner Corporation, Chicago, Ill.

[21] Appl. No.: 56,390

[22] Filed: Jul. 11, 1979

[51] Int. Cl.[3] ..... H01H 35/34

[52] U.S. Cl. ..... 200/83 P; 200/670 A; 200/302

[58] Field of Search ..... 200/81 R, 81.4, 83 R, 200/83 P, 83 J, 67 A, 67 D, 67 DA, 302

[56] References Cited

U.S. PATENT DOCUMENTS

| | | | |
|---|---|---|---|
| 3,594,521 | 7/1971 | Roll | 200/83 P |
| 3,984,650 | 10/1976 | Budlane | 200/83 P |
| 4,121,074 | 10/1978 | Orcutt | 200/302 |
| 4,172,412 | 10/1979 | Sepso | 200/83 P |

*Primary Examiner*—Gerald P. Tolin

*Attorney, Agent, or Firm*—Augustus G. Douvas

[57] ABSTRACT

A vacuum operated electric switch designed for automotive applications having a vacuum responsive diaphragm that releases the switch mechanism for movement from one of its two stable conditions. The switch assembly has a spring biased pivotal overcenter contact blade movable between two stationary contacts to give the switch a snap action characteristic. Stationary contact wiring is eliminated by bending the ends of the terminals, which are insert molded in a switch base, to directly support the contacts. Movable contact wiring is eliminated by staking a bracket for the movable contact blade directly to one of the terminals so that the bracket provides the conductive path between the movable contact and its terminal. The switch assembly is designed as a complete integral subassembly that may be manufactured separately from the main switch housing having a vacuum chamber and diaphragm therein.

21 Claims, 7 Drawing Figures

VACUUM OPERATED SWITCH

BACKGROUND OF THE INVENTION

Vacuum or pressure operated switches have been used in the automotive industry for many years to transduce a change in pressure to an electric signal usable either to control another function or to simply provide an indication of condition to the operator. An example of the latter would be a pressure transducer for actuating a warning light on the vehicle dashboard when oil pressure falls too low.

The present vacuum operated switch, however, is specially designed for the former purpose, i.e., to control a subsequent function. In this case the switch is designed to sense engine manifold vacuum and to control a transmission converter locking mechanism. It is also designed to energize and deenergize emission control components. While designed for the requirements of these specific applications, the present switch assembly of course has other applications as well.

The basic switch mechanism is of the movable over-center contact blade type that carries a contact pivotable between two aligned stationary contacts. A spring biases the blade from its center position to provide the necessary snap action for the switch. This basic switch mechanism is combined with a diaphragm actuator to form the complete switch. This mechanism is prior art, but the prior art switches of this type all require an excessive number of parts for supporting the stationary contacts, as well as the movable contact blade, and they also require wiring between the terminal and contacts, both of which contribute significantly not only to the cost of the parts and particularly to the labor cost in assembling the device, but also negatively to the reliability of the switch itself.

It is a primary object of the present invention to ameliorate these prior art problems found in vacuum and pressure switches.

SUMMARY OF THE INVENTION

In accordance with the present invention, a vacuum operated electric switch is provided for sensing the pressure in the manifold of an automobile and to provide an electric signal, or signals, to control transmission and emission control functions. The switch includes a cup-shaped housing having a cover at the closed end defining a sensing chamber. This sensing chamber has no movable parts except a diaphragm which only bends. A unitary switch subassembly is fitted into the opened end of the housing and it is designed so that it may be completely manufactured prior to insertion into the housing and in contact with the diaphragm to reduce manufacturing time through independent assembly, as well as making assembly easier.

The switch subassembly includes two spaced stationary contacts, with an over-center movable contact blade carrying a contact engageable selectively with the stationary contacts. A spring engages the contact blade to bias it away from its center position towards the stationary contacts to give the switch its snap action characteristic. All three terminals for the subassembly are made from a single stamping that is insert-molded in a body or base of the switch subassembly. This eliminates any fasteners for the terminals. The upper ends of the terminals project from the base and two of them are bent over 90 degrees with respect to the plane of the insert-molded portions of the terminals, and the ends directly support the stationary contacts. This eliminates any need for wiring or supporting the stationary contacts.

The contact blade is pivoted over-center by a pivotal lever that hooks over one end of the contact blade. This lever is actuated by a plunger assembly slidable in a cup-shaped cover for the subassembly. The switch subassembly, therefore, has basically only three moving parts; (1) the contact blade, (2) the lever, and (3) the plunger——providing greatly reduced cost and increasing the reliability of the switch significantly.

All wiring is also eliminated in connection with the movable contact. A bracket for pivotally supporting the actuating lever is staked directly to one of the terminals insert molded in the subassembly body. This provides an electric circuit path between the movable contact and its terminals through the contact blade, the lever and this bracket. The bracket itself not only supports the lever and also provides an electric conducting path to the movable contact terminal, but further supports the spring that biases the movable contact blade from its center position.

It is readily seen that the present vacuum switch is vastly superior in design and easier to manufacture than prior vacuum switch assemblies. It requires no special wiring for the terminals or contacts since all wiring is provided by the elemental switch parts themselves. Only one bracket is required for the entire switch subassembly. There are no moving parts associated with the diaphragm vacuum chamber since the actuating plunger is part of the switch subassembly and the diaphragm is springless.

DETAILED DESCRIPTION OF THE PREFERRED EMBODIMENT

Figure 1:
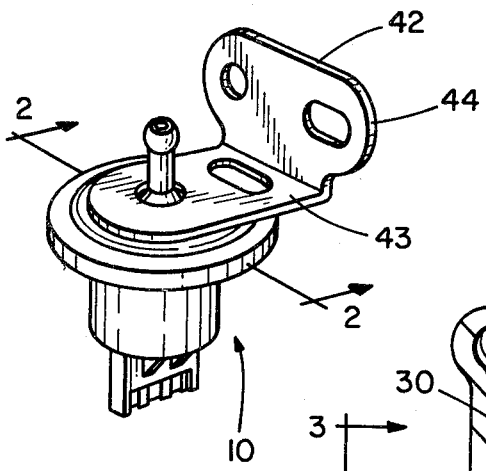
FIG. 1 is a perspective view of the present vacuum operated switch assembly.
Figure 2:
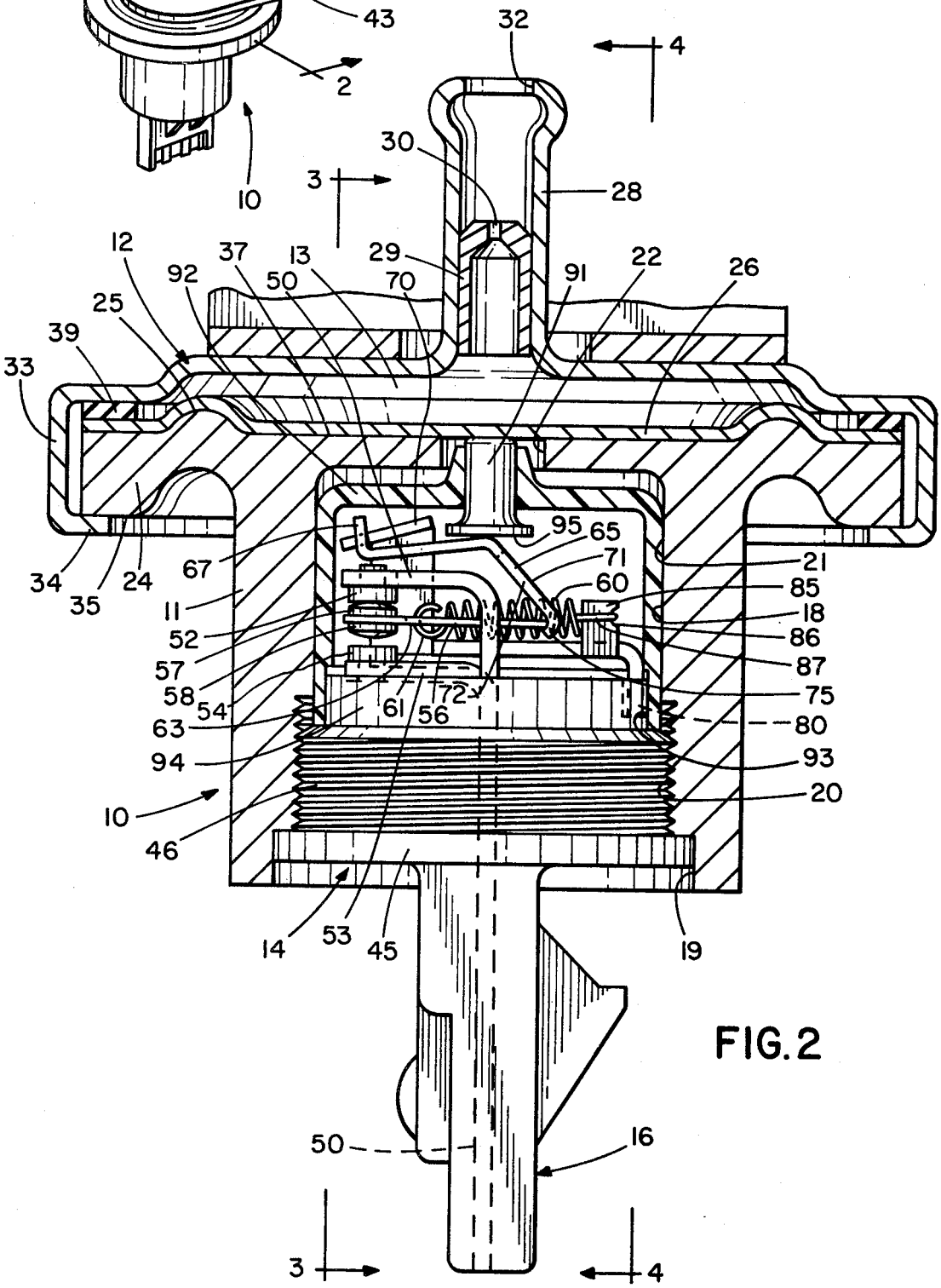
FIG. 2 is an enlarged cross-section of the switch assembly shown in FIG. 1, taken generally along line 2—2 in FIG. 1.

Viewing the drawings, and particularly FIGS. 1 and 2, the present diaphragm operated switch assembly 10 is seen to generally include a cup-shaped main housing 11 having a cup-shaped cover 12 at one end defining a vacuum chamber 13, and a unitary switch subassembly 14 in the open end of the housing that completes circuits to terminals at terminal end 16 of the switch subassembly as the switch moves to one of its two stable positions.

The housing 11 is a one-piece member of cup-shaped configuration having a stepped bore 18 including an enlarged portion 19 at the open end of the housing, an intermediate threaded portion 20 for holding the switch assembly 14 in position, and a smooth upper portion 21 for slidably receiving the upper end of the switch assembly 14 and a reduced portion 22 that provides communication between the interior of the housing 11 and the pressure chamber 13. The upper end of housing 11 has an integral annular flange 24 having a semi-toroidal upper surface projection 25 for holding and sealing metal diaphragm 26 in its proper position.

The cup-shaped cover 12 has a centrally disposed upwardly axially extending fitting 28 formed integrally therewith. Fitting 28 is adapted to be connected to the manifold of an automobile through suitable tubing (not shown) so that the chamber 13 is subjected to manifold pressure, or more appropriately vacuum. The fitting 28 carries a nozzle member 29 having a narrow orifice 30 for controlling the rate of application of vacuum to the chamber 13. Fitting 28 has a large opening 32 at the end thereof, providing unrestricted communication with manifold pressure.

The cover 12 has a cylindrical side wall 33 that fits over the flange 24 of the housing 11 and it is fixed to the flange by roll-staking the sidewall 33 around the flange forming an inwardly bent portion 34 on sidewall 33 that engages bottom wall 35 on flange 24. Thus, during assembly the pressure chamber 13 is formed first by placing the diaphragm 26 on upper surface 37 of the housing 11 fitting it over the toroidal projection 25, thereafter placing an annular gasket 39 on the diaphragm 26, thereafter positioning cover 12 over the flange 24 in engagement with the gasket 19, and then roll-staking the sidewall 33 of the cover to the flange, as it is shown in the drawings. This provides a completely independent subassembly of the pressure chamber 13 from the subassembly of the switch assembly 14, permitting the parts to be processed simultaneously rather than dependently during the manufacturing operation.

An L-shaped bracket 42 supports the entire switch assembly 10 for mounting the switch within the engine compartment. Bracket 42 has a leg portion 43 fixed to the top wall of the cover 12 and a second leg portion 44 adapted to be mounted to a wall within the engine compartment.

The switch subassembly 14 is an integral unit that is inserted as a unit into the housing 18 after assembly. The switch subassembly is seen to include a generally annular body 45 having a threaded portion 46 threadedly engaged with threads 20 in the housing 11. The body 45 is a plastic molding having an integral generally rectangular terminal end 16 into which terminals 48, 49 and 50 are insert molded. The terminals 48, 49 and 50 are insert molded into the body 45 as a single interconnected plate, and thereafter the upper ends of the terminals 48, 49 and 50 are separated by cutting and then bent over to the positions shown in the drawings. The upper end of terminal 50 is arcuate in configuration, as seen clearly by arcuate portion 51 seen in FIG. 5. This arcuate portion 51 is bent over 90 degrees with respect to the plane of the terminals 48, 49 and 50, and carries a fixed contact 52 at its end.

Figure 3:
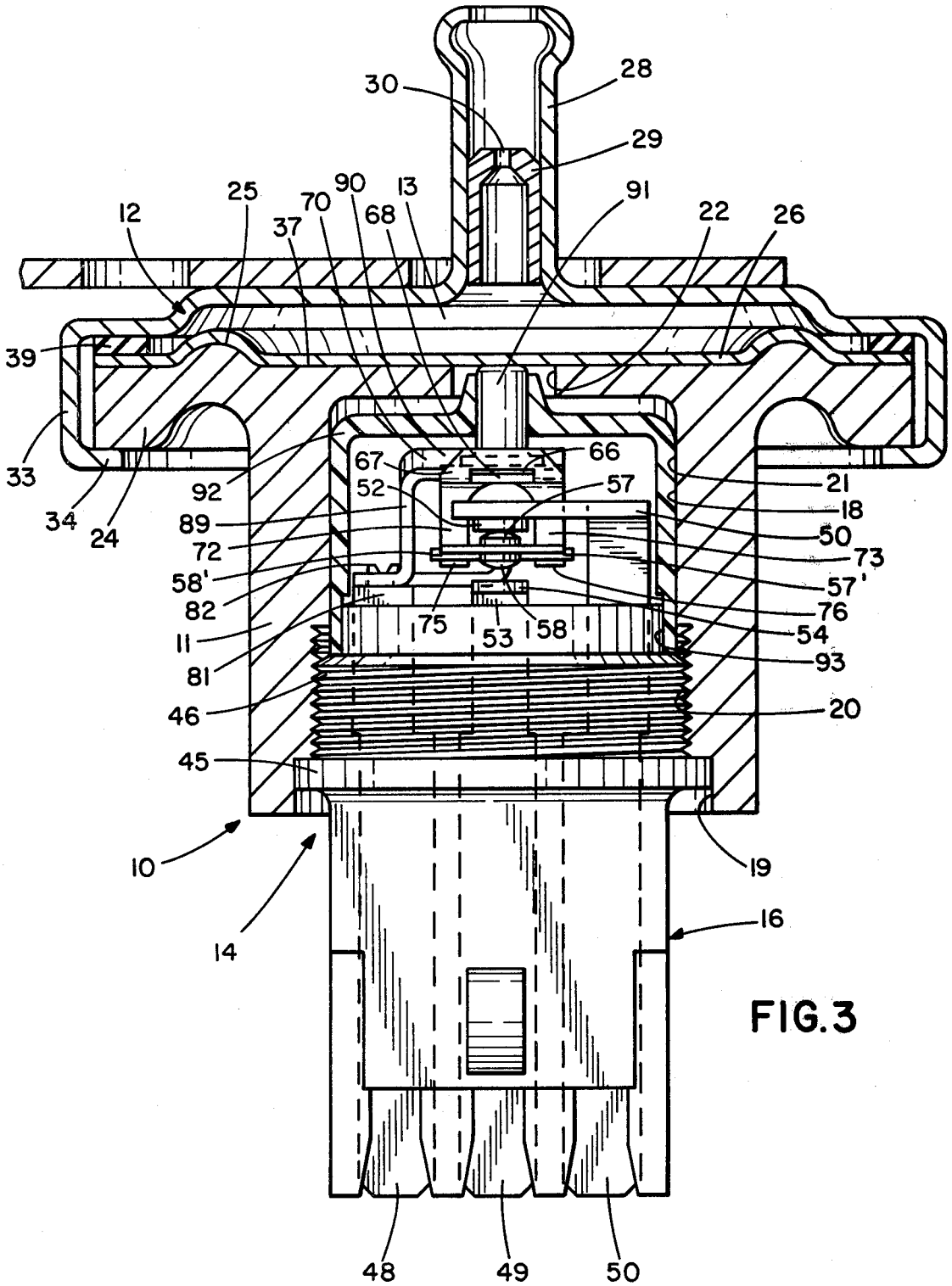
FIG. 3 is a cross-section of the present vacuum operated switch assembly, taken generally along line 3—3 of FIG. 2.

The upper end of terminal 49 also projects upwardly from the molded body 45 and it is also bent over 90 degrees with respect to the plane of the terminals 48, 49 and 50, as seen by terminal portion 53 in FIGS. 2 and 3. The end of terminal portion 53 carries another fixed contact of the switch, contact 54 aligned with contact 52.

Figure 4:
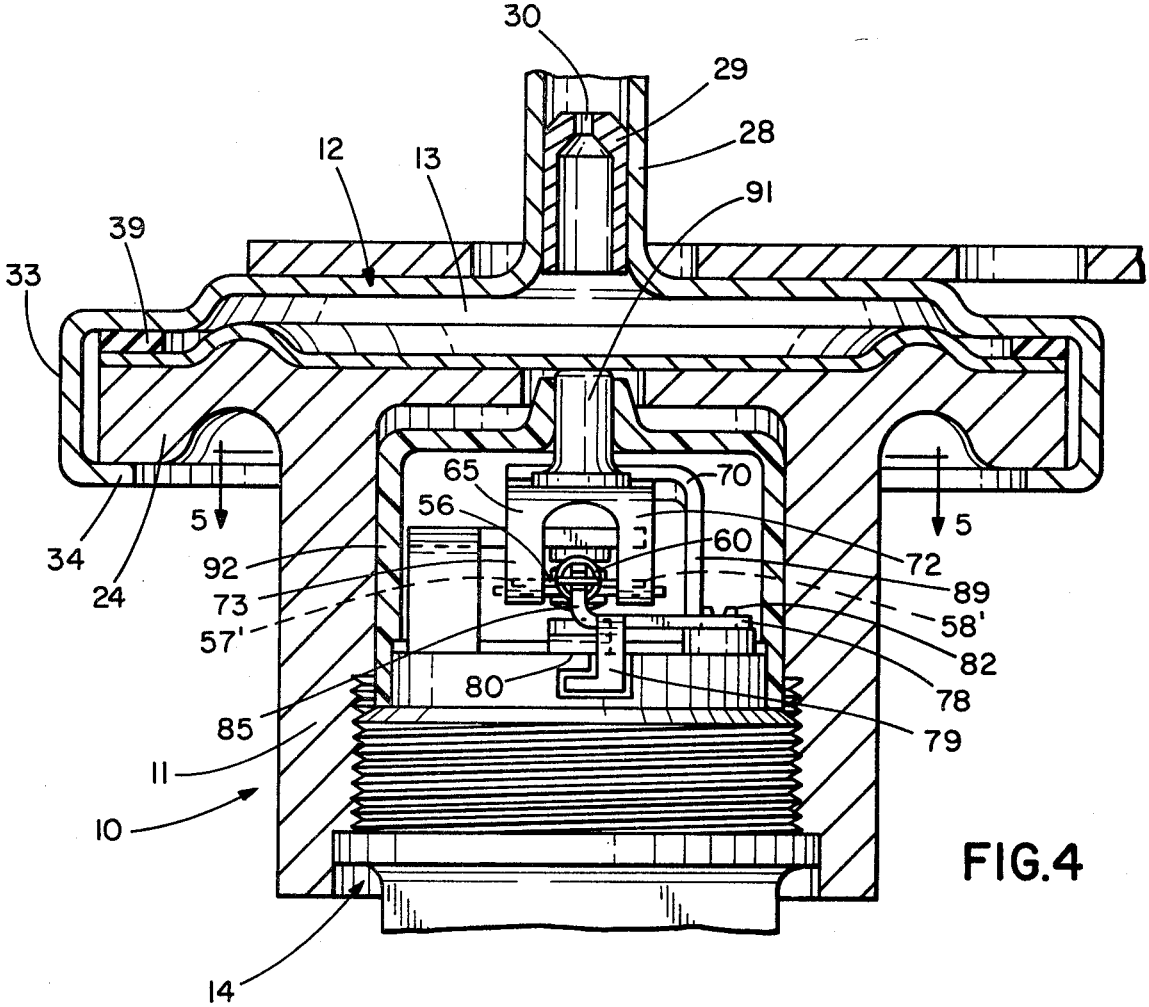
FIG. 4 is a fragmentary section taken generally along line 4—4 of FIG. 2.
Figure 5:
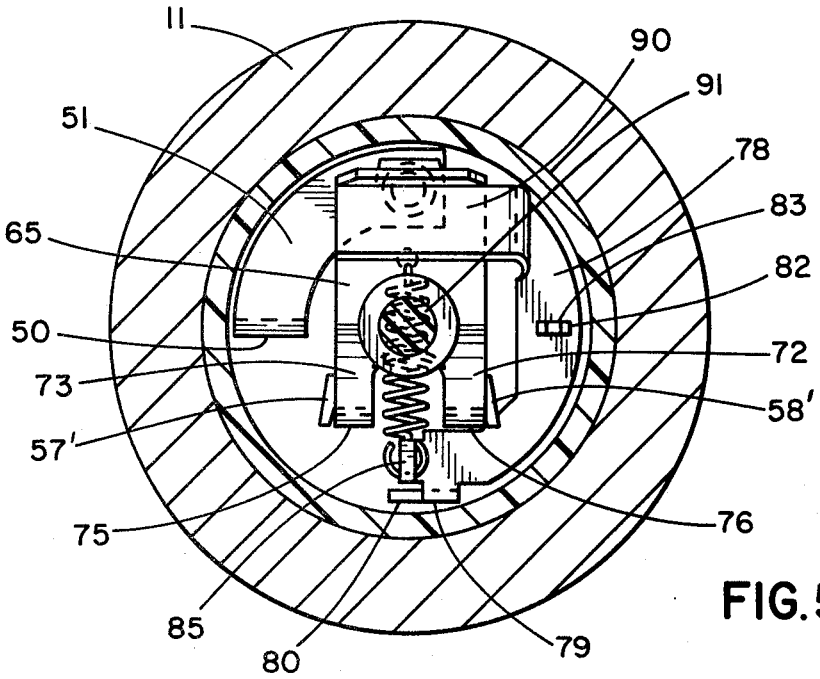
FIG. 5 is a horizontal cross-section taken generally along line 5—5 of FIG. 4.
Figure 7:
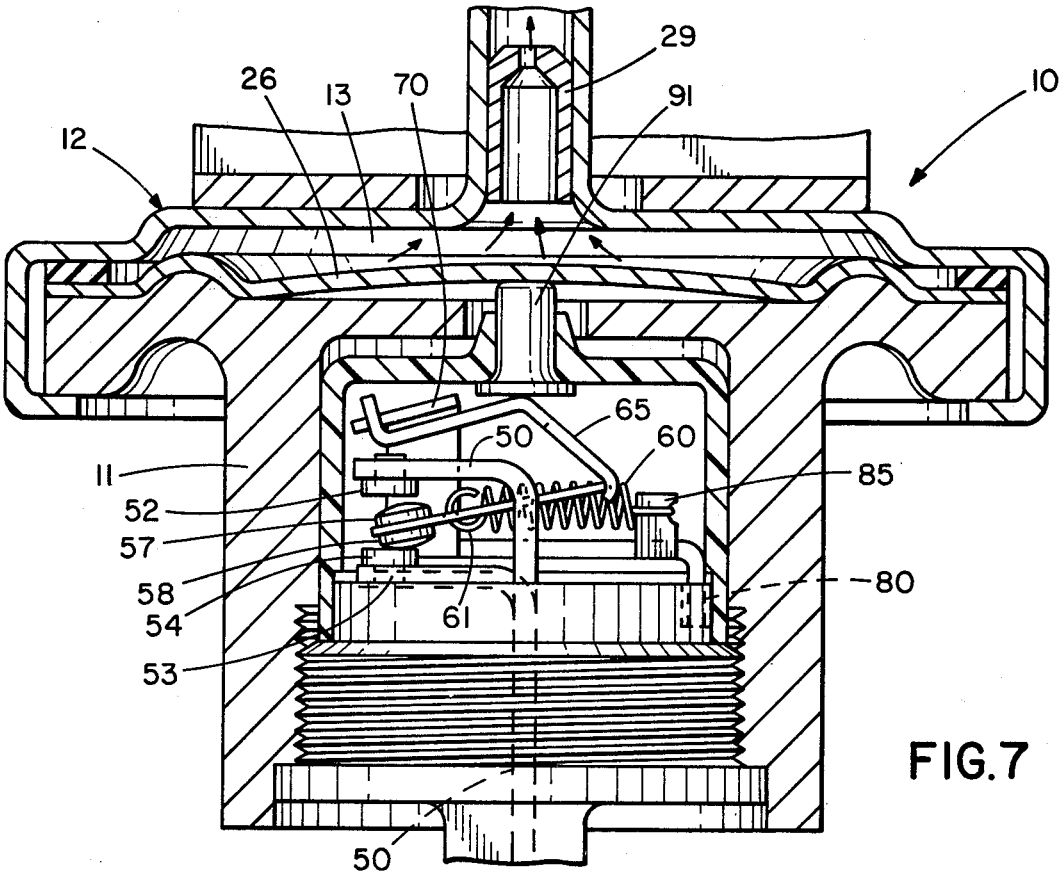
FIG. 7 is a cross-section taken generally in the plane of FIG. 2 with a vacuum being applied to the diaphragm sufficient to actuate the switch.

The movable contact for the switch is provided by a flat bifurcated contact blade 56 having upper and lower contacts 57 and 58 at the end thereof engageable selectively with the fixed contacts 52 and 54 as the blade 56 pivots from its position shown in FIG. 2 to its position shown in FIG. 7. As seen in FIGS. 4 and 5, contact blade 56 has spaced legs 57' and 58' that permit the blade to receive an over-center spring 60 having a hooked end 61 extending through an aperture 63 in the contact blade 56.

Spring 60 is a coil tension spring and because of its general alignment with the plane of the blade 56 serves an over-center function that tends to urge the blade 56 away from its position between the contacts 52 and 54 in one direction or the other so that the contact blade 56 has a first stable position where contact 57 is in engagement with contact 52, and a second stable position where contact 58 is in contact with fixed contact 54, achieving a bistable function for the switch, as well as its snap action movement. In this manner the contacts 52 and 54 act as abutments for the blade 56.

The contact blade 56 is supported, with the aid and urging of the tension spring 60, in a pivotal lever 65. Lever 65, as seen best in FIG. 3, has a rectangular oblong opening 66 in a substantially vertical end portion 67 on the lever. This opening 66 receives a tongue 68 on a fixed bracket 70 so that the lever 65 is pivotally supported on the bracket in the plane of FIG. 2 and transverse to the plane of FIG. 3.

The opposite end 71 of the lever 65 is bifurcated forming legs 72 and 73 that permit the passing of spring 60 freely therethrough. The ends of legs 72 and 73 are bent around, as shown at 75 and 76, to form hooks that receive the ends of the legs 57 and 58 on the contact blade 56. Spring 60 urges the blade into the hooked ends 75 and 76. In this manner the contact blade is supported on the lever 65, but pivotal movement is permitted between the contact blade 56 and the lever 65 to achieve the necessary over-center action of the contact blade 56.

As the lever 65 pivots counterclockwise from its position shown in FIG. 2 to its position shown in FIG. 7, pivoting the right end of the blade 56 above the axis of spring 60, spring 60 will rapidly rotate contact blade 56 in a counterclockwise direction, disengaging contact 57 from stationary contact 52 and engaging contact 58 with fixed contact 54.

An important aspect of the present invention is the manner in which the lever 65 is supported within the housing and more particularly the construction of the bracket 70 that pivotally supports the lever 65. Bracket 70 has an arcuate base portion 78, shown in FIG. 5, having an L-shaped projection 79 at one end received in a horizontally extending undercut recess 80 in the body 45 to aid in holding the bracket 70 to the body (see FIG. 4). The upper end of the terminal 48 projects from the body 45, as shown by terminal portion 81 in FIG. 3, and this end has a reduced projection 82 that is received in a rectangular aperture 83 in arcuate bracket portion 78, as shown in FIGS. 3 and 5. After positioning the bracket portion 78 over the projection 82, projection 82 is deformed in a conventional staking process so that the bracket is staked to the terminal. In this manner, because terminal 48 is insert-molded in the body 45, the bracket is securely fixed to the body without the need for any additional fastening. Moreover, the bracket 70 is electrically conductive as are lever 65 and contact blade 56. In this manner the contacts 57 and 58 are electrically connected to the terminal 48 through contact blade 56, lever 65 and bracket 70 without the need for any special wiring.

The bracket 70 has an upwardly bent end portion 85, as seen in FIGS. 2 and 5, that defines a seat for spring 60. Projection 85 has a recess 86 in the rear side thereof, as shown in FIG. 2, that receives a hook 87 on the end of coil spring 60.

The bracket 70 has an upstanding leg portion 89 bent 90 degrees over into a horizontal upper portion 90 that carries the tongue 68 pivotally supporting the lever 65.

The lever 65 is held in the position shown in FIG. 2 by plunger 91 slidable in a cup-shaped cover 92. The plunger 91 has an upper end in engagement with and biased by the diaphragm 26, and a lower end surface 95 slidably engaging the upper surface of the lever 65 as the lever 65 pivots. The cup-shaped housing member 92 completes the switch subassembly 14 and is carried by the body 45 by a snug fit between its counterbore 93 and a cylindrical boss 94 on body 45.

The switch assembly 14, including the body 45 with the cover member 92 fixed thereto, is removable as a unit to and from the housing 11.

The switch 10, in the position shown in FIG. 2, is termed in its normal position since the diaphragm 26 is relaxed. In this position switch contacts 52 and 57 are closed, so that these are termed the normally closed contacts, with terminal 48 conducting to terminal 50. In this position the diaphragm 26 biases the plunger 91 downwardly while the spring 60 biases plunger 91 upwardly through lever 65. In this position the right end of the contact blade 56 is slightly below the axis of spring 60 so that spring 60 tends to rotate the contact blade in a clockwise direction, closing contacts 52 and 57.

Figure 6:
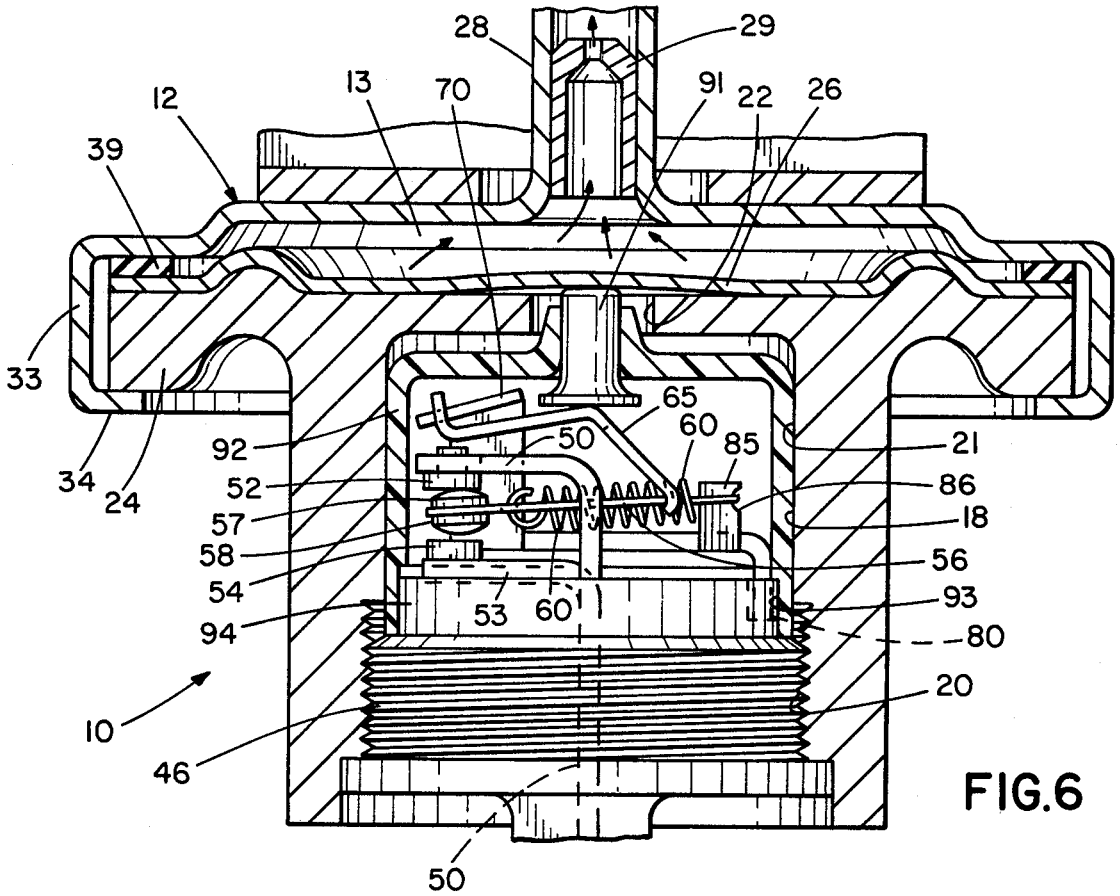
FIG. 6 is a fragmentary section taken substantially in the plane of FIG. 2 as a vacuum is applied to the diaphragm.

As a vacuum is applied to pressure chamber 13, the diaphragm 26 flexes upwardly adjacent the middle region as shown in FIG. 6, permitting the plunger 91 to move upwardly under the influence of spring 60, acting through lever 65. This action tends to rotate the contact blade 56 in a counterclockwise direction. In the position of the contact blade 56 shown in FIG. 6, the right end of contact blade 56 is coincident with the axis of spring 60, and this occurs just prior to switch actuation.

As a further vacuum is applied to chamber 13, diaphragm 26 flexes further upwardly from the position shown in FIG. 6, the lever 65 raises the right end of contact blade 56 above the center-line of spring 60, permitting the spring to rotate the blade rapidly in a counterclockwise direction, disengaging contacts 52 and 57 and closing contacts 58 and 54. This terminates conduction between terminals 48 and 50 and initiates conduction between terminals 48 and 49.

What is claimed is:

1. A vacuum or pressure operated electric switch, comprising; a housing having axially aligned contact abutments, a first contact on at least one of the abutments, a first terminal electrically connected to the contact, an over-center contact blade having a second contact movable between a first position in engagement with the first contact and a second position in engagement with one of said abutments, a second terminal electrically connected to said contact blade, spring means biasing said contact blade away from a center position thereof between the first contact and another of said abutments, a non-resilient lever member in the housing directly engaging and supporting said contact blade for movement between said first and second positions, a diaphragm in said housing defining a vacuum or pressure chamber therein, and a plunger between the diaphragm and the lever member normally biasing said lever in a direction to move the contact blade to one of said positions and when subjected to a predetermined vacuum or pressure in said chamber permitting the lever and spring to move the contact blade to the other of said positions.

2. A vacuum or pressure operated electric switch, comprising; a housing having axially aligned contact abutments, a first contact on at least one of the abutments, a first terminal electrically connected to the contact, an over-center contact blade having a second contact movable between a first position in engagement with the first contact and a second position in engagement with one of said abutments, a second terminal electrically connected to said contact blade, spring means biasing said contact blade away from a center position thereof between the first contact and another of said abutments, a lever member in the housing moving said contact blade between said first and second positions, a diaphragm in said housing defining a vacuum or pressure chamber therein, a plunger between the diaphragm and the lever member normally biasing said lever in a direction to move the contact blade to one of said positions and when subjected to a predetermined vacuum or pressure in said chamber permitting the lever and spring to move the contact blade to the other of said positions, and a bracket for supporting the lever member, said bracket being in electrical contact with the second terminal so that a conductive path is provided from the contact blade contact to the second terminal through the contact blade, the lever member and the bracket.

3. A vacuum or pressure operated electric switch as defined in claim 1, including a third contact on the other of said abutments, a third terminal connected to said third contact, said first, second and third terminals being substantially coplanar, said first and second abutments extending integrally from the first and second terminals and being bent over 90 degrees from the plane of said terminals into axial alignment with one another.

4. A vacuum or pressure operated electric switch as defined in claim 3, wherein one of said abutments is arcuate in configuration to place the first and third contacts in axial alignment.

5. An over-center switch assembly, comprising; first and second axially aligned abutments, a first contact on one of said abutments, an over-center contact blade having a contact thereon movable between a first position in engagement with said first contact and a second position in engagement with the other abutment, a spring biasing said contact blade away from a center position thereof toward one of said first and second positions, a non-resilient pivotally mounted lever member directly engaging and supporting said contact blade for moving it over-center between the first and second positions, said lever member being pivotally mounted about an axis perpendicular to the axis of alignment of said first and second abutments, and an axially movable plunger engaging the side of the lever member and biasing the lever member and the contact blade to one of said first and second positions.

6. An over-center switch assembly as defined in claim 5, including housing means forming a pressure chamber, a diaphragm in the pressure chamber engaging the plunger and biasing the plunger, said lever member and said contact blade to one of said first and second positions.

7. A vacuum or pressure operated switch, comprising; a housing, first and second terminals in said housing in substantially coplanar positions, one of said first and second terminals being bent over 90 degrees to the plane of the terminals and having a first contact therein, an abutment in the housing axially aligned with the first contact, a contact blade having a second contact thereon movable between a first position in engagement with said first contact and a second position in engagement with said abutment, a spring biasing said contact blade away from a center position between the first and second positions, said contact blade and contact thereon being electrically connected to the second terminal, a non-resilient lever in the housing directly engaging and supporting the contact blade to move the contact blade over-center to shift the contact blade contact between said first and second positions, and pressure operated diaphragm means for moving the lever.

8. A vacuum or pressure operated electric switch as defined in claim 7, wherein the first and second terminals are insert molded in the housing.

9. A vacuum or pressure operated electric switch, comprising; a housing, first and second terminals in said housing in substantially coplanar positions, one of said first and second terminals being bent over 90 degrees to the plane of the terminals and having a first contact thereon, an abutment in the housing axially aligned with the first contact, a contact blade having a second contact thereon movable between a first position in engagement with said first contact and a second position in engagement with said abutment, a spring biasing said contact blade away from a center position between the first and second positions, said contact blade and contact thereon being electrically connected to the second terminal, a lever in the housing operating the contact blade to move the contact blade over-center to shift the contact blade contact between said first and second positions, pressure operated diaphragm means for moving the lever, and a bracket in the housing for pivotally supporting the lever, said bracket being fixed directly to the second terminal so that a conductive path is provided between the contact blade contact and the second terminal through the lever and the bracket.

10. A vacuum or pressure operated electric switch, comprising; a housing, first, second and third coplanar terminals in the housing, one of said terminals having an arcuate upper end bent over 90 degrees with respect to the plane of the terminals and having a first contact on the end thereof, a second of said terminals having a straight end bent over 90 degrees with respect to the plane of the terminals and having a second contact on the end thereof in axial alignment with the first contact, an over-center contact blade having a third contact on the end thereof movable between a first position in engagement with the first contact and a second position in engagement with the second contact, said third contact being electrically connected to the third terminal, a spring biasing the contact blade, vacuum or pressure operated diaphragm means for operating the contact blade to move the third contact between said first and second positions, a bracket in the housing, and a lever pivotally mounted on the bracket to move the contact blade, said bracket being connected directly to the third terminal to provide a circuit path between the third contact and the third terminal through the contact blade, the lever, and the bracket.

11. A vacuum or pressure operated electric switch as defined in claim 10, wherein the bracket is staked to the end of the third terminal.

12. A vacuum or pressure operated electric switch, comprising; a housing, first and second terminals projecting from the housing, a stationary first contact in said housing connected to said first terminal, an over-center contact blade having a second contact movable into and out of engagement with said first contact, a spring means biasing said contact blade from a center position thereof, a lever engaging said contact blade for moving it over center, a bracket in said housing supporting said lever, said bracket being electrically conductive and fixed to the second terminal so that the second contact is electrically connected to the second terminal through the contact blade, the lever, and the bracket eliminating the need for any special wiring, and a vacuum or pressure operated means for displacing the lever.

13. A vacuum or pressure operated electric switch as defined in claim 12, wherein the bracket is staked to the second terminal.

14. A vacuum or pressure operated electric switch as defined in claim 12, wherein the first and second terminals are coplanar and insert molded in the housing, one end of the first terminal being bent 90 degrees with respect to the plane of the terminals, said second terminal having a straight end to which said bracket is staked.

15. A vacuum or pressure operated electric switch as defined in claim 12, including a spring means support projecting from and formed integrally with said bracket, said spring means engaging the contact blade and being supported on said spring means support.

16. A vacuum or pressure operated electric switch, comprising; a housing, first and second terminals projecting from the housing, a first contact in the housing connected to said first terminal, a contact blade having a second contact movable into and out of engagement with the first contact by over-center movement, a spring biasing the contact blade from a center position thereof in both directions, a lever in the housing for operating the contact blade, a bracket in the housing pivotally supporting the lever, said bracket having an integral spring support projection, said spring being supported on said projection, and a vacuum or pressure operated means for moving the lever.

17. A vacuum or pressure operated electric switch as defined in claim 16, wherein the bracket has a tongue projection, said lever having a slot at one end thereof in which said tongue fits to pivotally support the lever on the bracket, the other end of said lever forming a hook for receiving and engaging one end of the contact blade opposite the second contact.

18. A vacuum or pressure operated electric switch, comprising; a housing, first and second terminals projecting from the housing, a first contact in the housing connected to said first terminal, a contact blade having a second contact movable into and out of engagement with the first contact by over-center movement, a spring biasing the contact blade from a center position thereof in both directions, a lever in the housing for operating the contact blade, a bracket in the housing pivotally supporting the lever, said bracket having an integral spring support projection, said spring being supported on said projection, and a vacuum or pressure operated means for moving the lever, said bracket being staked to the second terminal so that said second contact is electrically connected to the second terminal through the contact blade, the lever and the bracket without the need for special wiring.

19. A vacuum or pressure operated electric switch, comprising, a cup-shaped housing having a throughbore, an open end, and a flange opposite the open end, a cup-shaped cover with a vacuum or pressure fitting over the flanged end and connected to said flange and defining a chamber between it and the housing, a diaphragm in said chamber responsive to a vacuum or pressure being applied to the vacuum or pressure fitting, and an enclosed self supporting switch assembly inserted into the open end of the housing as a unit, said switch assembly including an axially slidable plunger for actuation thereof directly engaging the diaphragm.

20. A vacuum or pressure operated electric switch as defined in claim 19, wherein the switch assembly includes a body, terminals carried by said body, a first contact carried by said body connected to said first terminal, a contact blade having a second contact movable into and out of engagement with the first contact, said second contact being connected to the second terminal, and a lever in the housing for moving the contact blade, said switch assembly including a cup-shaped cover having a plunger slidable therein that engages the diaphragm to be actuated thereby after the switch assembly is inserted as a unit in the open end of the cup-shaped housing.

21. A vacuum or pressure operated electric switch as defined in claim 19, wherein the cup-shaped cover is staked to the housing flange.

* * * * *